US006454144B1

(12) United States Patent
Muroi et al.

(10) Patent No.: US 6,454,144 B1
(45) Date of Patent: Sep. 24, 2002

(54) CONTINUOUS CASTING NOZZLE

(75) Inventors: Toshiyuki Muroi; Toshikazu Takasu; Yuji Ozeki; Hisatake Okumura, all of Gifu (JP)

(73) Assignee: Akechi Ceramics Kabushiki Kaisha (JP)

( * ) Notice: Subject to any disclaimer, the term of this patent is extended or adjusted under 35 U.S.C. 154(b) by 0 days.

(21) Appl. No.: 09/543,752

(22) Filed: Apr. 5, 2000

(30) Foreign Application Priority Data

Oct. 14, 1999 (JP) ..... 11-291833
Dec. 2, 1999 (JP) ..... 11-343812

(51) Int. Cl.[7] ..... B22D 35/00
(52) U.S. Cl. ..... 222/606; 164/437
(58) Field of Search ..... 222/606; 164/437, 164/337

(56) References Cited

U.S. PATENT DOCUMENTS 1,797,566 A * 3/1931 Brown ..... 164/437
4,399,985 A * 8/1983 Eastwood ..... 266/265
5,467,904 A * 11/1995 Shaw ..... 222/606

* cited by examiner

*Primary Examiner*—Scott Kastler
(74) *Attorney, Agent, or Firm*—Cantor Colburn LLP

(57) ABSTRACT

There is provided a continuous casting nozzle comprising a nozzle main body including a neck portion, a middle portion, and a lower portion, made of a refractory material having an inner bore through which molten metal flows, and a plurality of metal bars embedded along the longitudinal direction of the nozzle main body in at least one portion inside the refractory material forming the nozzle main body.

10 Claims, 7 Drawing Sheets

CONTINUOUS CASTING NOZZLE

BACKGROUND OF THE INVENTION

1. Field of the Invention

The present invention relates to a continuous casting nozzle used for continuous casting of steel, in which a plurality of metal bars are embedded inside at least one portion of a refractory material forming a nozzle main body including a neck portion, a middle portion, and a lower portion.

2. Description of Related Art

Conventionally, there is known a long nozzle for casting molten steel from a ladle without exposing the molten steel to the open air so as to prevent the molten steel from being secondarily oxidized. Recently, the capacity of a tundish, i.e., a molten steel receiving vessel, becomes larger in order to improve a quality of steel in the continues casting. Together with this trend of the tundish, a shape of the nozzle becomes larger and heavier. Furthermore, the nozzle is not discarded after a single continuous casting, but is used throughout multiple castings or reused. Thus a service life of the nozzle is improved. As a result, a required material for manufacturing the nozzle is substantially reduced. In general, an immersion nozzle is employed between the tundish and the mold to cast steel. The long nozzle has such shapes as shown in FIG. 8. FIG. 8 shows a straight type long nozzle (A) and a wide lower type long nozzle (B) which are respectively designed to satisfy a required quality of steel and practically used.

Since the long nozzle used for continuous casting is used for casting molten steel without exposing the molten steel to the open air so as to prevent the molten steel from being secondarily oxidized, the penetration of the open air caused by such phenomena as erosion, crack, breakage or the like during casting brings disastrous damage to the quality of steel. However, the long nozzle has a various kind of complex shapes in addition to the shapes as shown in FIG. 8, thus lowering the structural strength of the nozzle to cause breakage in the middle portion or neck portion of the long nozzle. On the other hand, the service life of the long nozzle has been improved, and the long nozzle is intended to be used throughout multiple castings. When the long nozzle is used throughout multiple castings, the inner surface of the long nozzle is eroded, or the outer surface of the long nozzle is oxidized, thus the thickness of the long nozzle is made thinner. As a result, the structural strength of the nozzle is lowered to cause breakage in the vicinity of the neck portion of the nozzle main body.

Furthermore, the following properties as the material of the long nozzle are required:

(1) excellent thermal shock resistance to the rapid heat at the time when the casting is started;
(2) large mechanical strength to prevent breakage and breakdown of the nozzle from occurring during casting;
(3) excellent erosion resistance to molten steel, slag or the like;
(4) excellent oxidization resistance.

There is not found a refractory to fully satisfy the above mentioned requirements, as yet. Since an aluminum graphite refractory partially satisfies the above mentioned requirement, the aluminum graphite refractory is frequently used according to the purpose and condition of the nozzle. However, when the long nozzle is broken and fallen at the time of starting the casting or during casting due to the thermal shock according to the rapid heat, the shortage of the mechanical strength, the erosion according to molten steel or slag, or progressive oxidation of the nozzle, the molten steel is splashed over operators working on the casting floor to cause a serious damage such as threatening life of the operators.

In order to solve the above mentioned problem, there are studied and practiced various kinds of means to settle the problem such that the shape of the nozzle is developed, or that the thickness of the nozzle is increased, but those means do not come to decisively solve the problem.

As one of the means to settle the problem, the steel plate is wound up around the outer surface of the neck portion of the nozzle main body to reinforce the strength of the nozzle. FIG. 7 shows a conventional nozzle in which the steel plate is wound up around the outer surface of the neck portion to reinforce the strength of the nozzle. As shown in FIG. 7, a metallic shell 104 is provided in the vicinity of neck portion in the upper portion of the long nozzle 103 to protect the refractory main body. Since the long nozzle is pushed upward from the lower side by a supporting device 105 to fit the long nozzle 103 to the lower nozzle 102 of the ladle 101, the metallic shell disfigures or deteriorates due to the heat and is lifted upward, thus the outer peripheral portion of the long nozzle at the lower end of the metallic shell is progressively oxidized. The long nozzle reached under the above condition is broken or damaged by the vibration caused by the molten steel flowing through the inner bore of the nozzle during casting or the shock caused by the falling of the molten steel at the beginning of the casting, thus casing disastrous damage.

Accordingly, an object of the present invention is to provide a continuous casting nozzle in which the strength of the neck portion and the lower portion is enhanced, there is no danger of cracking and breaking, high-quality steel can be supplied steadily, the safety during operation can be ensured, and the cost of refractories can be reduced.

SUMMARY OF THE INVENTION

To solve the above problems, the inventors of the present invention have intensively studied. As a result, it was found that a continuous casting nozzle can be provided in which cracking and breaking of the nozzle can be prevented to ensure a required strength, a raw refractory material can be charged uniformly in molding the nozzle, and the cost can be decreased by embedding a plurality of metal bars at least along the longitudinal direction of a nozzle main body in at least one portion inside a refractory material forming a nozzle main body including a neck portion, a middle portion, and a lower portion. Further, it was found that when the metal bars are embedded along the longitudinal direction of the nozzle main body without embedding stainless steel bars in an annular form, substantially the same strength as that of the nozzle provided with stainless steel bars embedded in an annular form can be obtained. The present invention was made on the basis of the above-mentioned findings.

The first embodiment of the continuous casting nozzle of the invention comprises a nozzle main body including a neck portion, a middle portion and a lower portion, made of refractory material, having an inner bore through which molten metal flows; and a plurality of metal bars embedded inside said neck portion both in a vertical direction and a horizontal direction.

In the second embodiment of the continuous casting nozzle of the invention, a ratio of outer diameter of said metal bar embedded in a vertical direction to outer diameter of said metal bar embedded in a horizontal direction is within a range from 3/1 to 15/1.

In the third embodiment of the continuous casting nozzle of the invention, said plurality of metal bars embedded in a horizontal direction are embedded in said neck portion of said nozzle main body within an area ranging from at least 5 cm above a point in which an inclined surface of said neck portion intersects a vertical surface thereof to at least 15 cm below said point.

In the fourth embodiment of the continuous casting nozzle of the invention, said plurality of metal bars are embedded in a thickness direction of said neck portion within a range of at least 1.5 cm from a surface of said inner bore.

The fifth embodiment of the continuous casting nozzle of the invention comprises a nozzle main body including a neck portion, a middle portion and a lower portion, made of refractory material, having an inner bore through which molten metal flows; and a plurality of metal bars embedded inside of at least one portion of said refractory material forming said nozzle main body along a longitudinal direction thereof.

In the sixth embodiment of the continuous casting nozzle of the invention, said plurality of metal bars are embedded inside an area of said nozzle main body ranging from said neck portion through said middle portion to said lower portion.

In the seventh embodiment of the continuous casting nozzle of the invention, said plurality of metal bars are embedded inside vicinity of said neck portion of said nozzle main body.

In the eighth embodiment of the continuous casting nozzle of the invention, said plurality of metal bars are embedded inside said lower portion of said nozzle main body.

In the ninth embodiment of the continuous casting nozzle of the invention, said plurality of metal bars comprise a first metal bars embedded inside said neck portion of said nozzle main body and a second metal bars embedded inside said lower portion of said nozzle main body.

In the tenth embodiment of the continuous casting nozzle of the invention, said first metal bars embedded inside said neck portion and said second metal bars embedded inside said lower portion respectively extend to said middle portion of said nozzle main body, and are overlapped in said middle portion.

In the eleventh embodiment of the continuous casting nozzle of the invention, said plurality of metal bars are embedded at nearly regular intervals.

In the twelfth embodiment of the continuous casting nozzle of the invention, a cross sectional area of said plurality of metal bars comprises a round, oval, polygonal, or pentacle shape.

In the thirteenth embodiment of the continuous casting nozzle of the invention, a metal net is embedded together with said plurality of metal bars.

DETAILED DESCRIPTION OF THE PREFERRED EMBODIMENTS

Figure 1A:
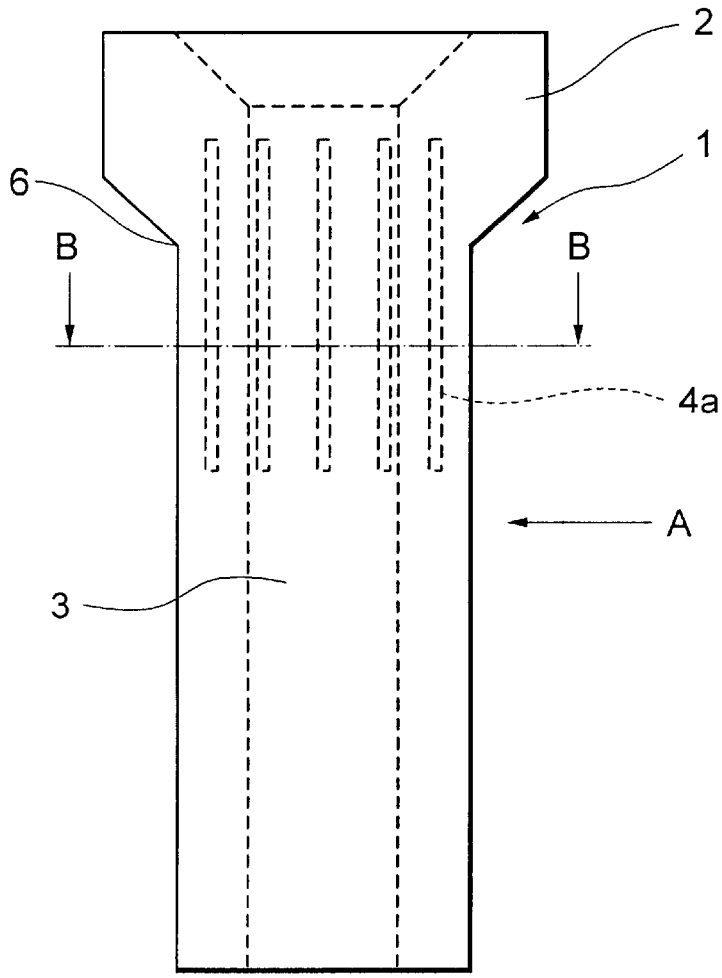
FIG. 1(*a*) is a front view showing one embodiment of a continuous casting nozzle in accordance with the present invention, and FIG. 1(*b*) is a sectional view taken along the line B—B of FIG. 1(*a*) showing one embodiment of a continuous casting nozzle in accordance with the present invention.

A continuous casting nozzle in accordance with the present invention comprises a nozzle main body including a neck portion, a middle portion, and a lower portion, made of a refractory material having an inner bore through which molten metal flows, and a plurality of metal bars embedded in the vertical and horizontal directions of the nozzle main body in at least one portion inside the refractory material forming the nozzle main body.

More specifically, in the refractory material in the vicinity of the neck portion of the nozzle main body, for example, a plurality of stainless steel bars having an outer diameter of at least 3 mm are embedded along the longitudinal direction of the nozzle main body at substantially equal intervals, and furthermore a plurality of stainless steel bars having an outer diameter of up to 1 mm are embedded in an annular form at substantially equal intervals in the direction perpendicular to the longitudinal direction of the nozzle main body, by which the strength in the vicinity of the neck portion of the nozzle main body is increased, and the occurrence of cracking and the breaking are prevented.

In the continuous casting nozzle in accordance with the present invention, for example, a long nozzle, the thus embedded stainless steel structure distributes stresses caused by both of thermal shock at the start of casting and mechanical shock during casting, thus a phenomenon such as breakage can be prevented from occurring.

The stainless steel bar embedded in the vertical direction preferably has an outer diameter of at least 3 mm. With the outer diameter of less than 3 mm, the vicinity of the neck portion can not be effectively protected against vibrations which are applied to the long nozzle during casting. The stainless steel bar embedded in the horizontal direction preferably has an outer diameter of up to 1 mm. Since the wall thickness of the long nozzle decreases at the time of molding, it is expected that the stainless steel bar is easily deformed and shrunk accordingly by a pressure during molding. The maximum diameter of the stainless steel bar thus easily deformed and shrunk is 1 mm. The outer diameter is therefore preferably up to 1 mm. As the material of the metal bar, stainless steel, steel (for example, heat-resisting steel or carbon steel), or titanium alloy steel, molybdenum alloy steel or the like is preferably used. Stainless steel is excellent in heat resistance and workability.

Furthermore, in the continuous casting nozzle in accordance with the present invention, for the plurality of metal bars embedded in the vertical and horizontal directions, a ratio of the outer diameter of the metal bar in the vertical direction to the outer diameter of the metal bar in the horizontal direction is within the range of 3/1 to 15/1.

With the ratio outside the range of below 3:1, the frame of the metal bars is not allowed a required contraction at the time of molding. On the other hand, with the ratio outside the range of above 15:1, the outer diameter of the metal bar in the horizontal direction becomes too small, so that the structural strength of the frame itself of the metal bars is lowered.

Furthermore, in the present invention, the plurality of horizontal metal bars are embedded in the neck portion of the nozzle main body within an area ranging from at least 5 cm above a point in which an inclined surface of said neck portion intersects a vertical surface thereof to at least 15 cm below the point.

The reason why the upper end of the embedded metal bars is located at a distance of at least 5 cm above the point at which an inclined surface of the neck portion intersects a vertical surface thereof is that if the distance is below 5 cm, the strength of the neck portion on the upper side of the point at which an inclined surface of the neck portion intersects a vertical surface thereof cannot be maintained sufficiently against shocks and vibrations applied to the long nozzle. In addition, the reason why the lower end of the embedded metal bars is located at a distance of at least 15 cm below the point at which an inclined surface of the neck portion intersects a vertical surface thereof is that if the distance is below 15 cm, the strength of the neck portion on the lower side of the point at which an inclined surface of the neck portion intersects a vertical surface thereof cannot be maintained sufficiently against shocks and vibrations applied to the long nozzle.

Furthermore, in the present invention, the plurality of metal bars are embedded in a thickness direction of the neck portion within a range of at least 1.5 cm from a surface of the inner bore. The reason why the metal bars are embedded in a thickness direction of the neck portion within a range of at least 1.5 cm from a surface of the inner bore is that if the distance is below 1.5 cm, there is a possibility of occurrence of cracking in the inner bore due to shocks and vibrations applied to the long nozzle.

A continuous casting nozzle comprises a nozzle main body including a neck portion, a middle portion and a lower portion, made of refractory material, having an inner bore through which molten metal flows; and a plurality of metal bars embedded inside said neck portion both in a vertical direction and a horizontal direction.

More specifically, the plurality of metal bars may be embedded in an area ranging from the vicinity of the neck portion down to the lower portion through the middle portion of the refractory material forming the nozzle main body. In other words, the metal bars may be embedded over the whole range in the longitudinal direction of the nozzle main body. Furthermore, the plurality of metal bars may be embedded at substantially equal intervals.

Furthermore, the plurality of metal bars may be embedded only inside the vicinity of the refractory material forming the neck portion of the nozzle main body. By embedding the metal bars in this manner, the strength of the neck portion of the nozzle main body may be enhanced, thus so called neck breakage of the nozzle can be effectively prevented.

Furthermore, the plurality of metal bars may be embedded only inside the refractory material forming the lower portion of the nozzle main body. By embedding the metal bars in this manner, the strength of the lower portion of the nozzle can be enhanced, thus the lower end portion of the nozzle can be prevented from falling off.

Furthermore, the plurality of metal bars may include metal bars embedded inside the vicinity of the refractory material forming the neck portion of the nozzle main body and another metal bars embedded inside the refractory material forming the lower portion of the nozzle main body. In other words, the plurality of respective separate metal bars are embedded inside the refractory material in the vicinity of the neck portion of the nozzle main body and in the lower portion of the nozzle main body. By embedding the metal bars in this manner, the strength of the neck portion of the nozzle main body can be enhanced, so that neck breakage of nozzle can be prevented, and also the strength of the lower portion of the nozzle can be enhanced, so that the lower end portion of the nozzle can be prevented from falling off.

Furthermore, the metal bars embedded inside the refractory material forming a portion in the vicinity of the neck portion of the nozzle main body, and the another metal bars embedded inside the refractory material forming the lower portion of the nozzle main body may be extended to the middle portion of the nozzle main body, respectively, and may be embedded by being overlapped with each other at the middle portion.

The present invention will be described further in detail with reference to the accompanying drawings.

Figure 1B:
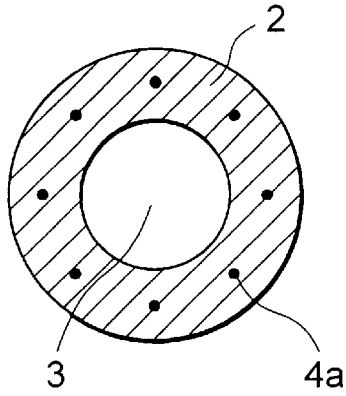
Figure 2A:
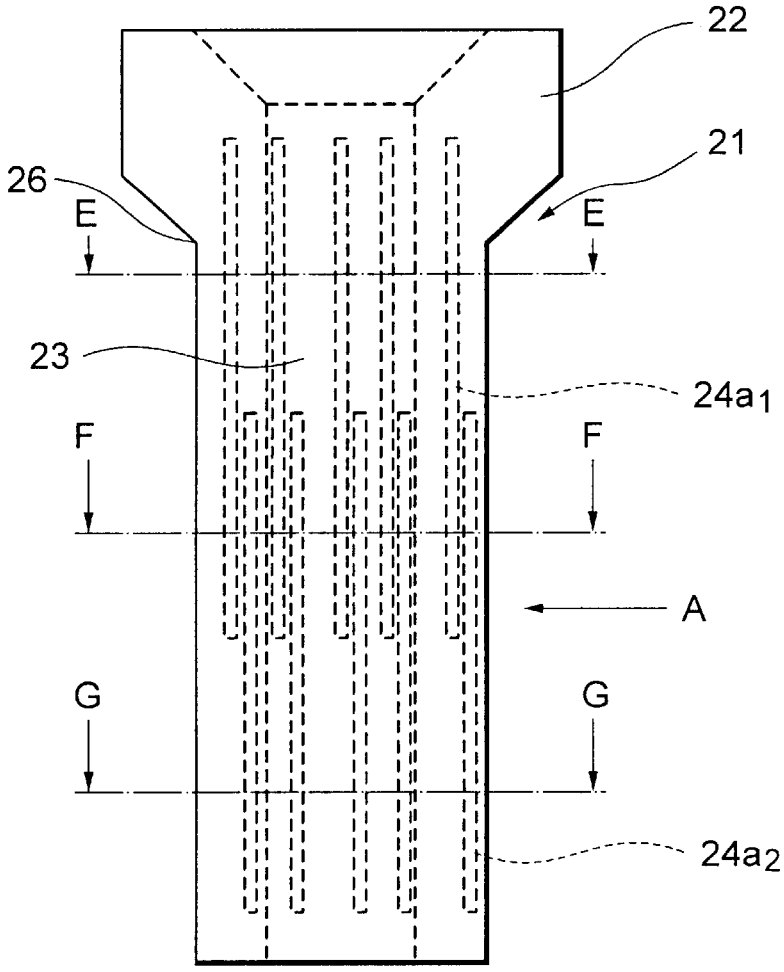
FIG. 2(*a*) is a front view showing another embodiment of a continuous casting nozzle in accordance with the present invention, FIG. 2(*b*) is a sectional view taken along the line E—E of FIG. 2(*a*) showing another embodiment of a continuous casting nozzle in accordance with the present, and FIG. 2(*c*) is a sectional view taken along the line F—F of FIG. 2(*a*) showing another embodiment of a continuous casting nozzle in accordance with the present, and FIG. 2(*d*) is a sectional view taken along the line G—G of FIG. 2(*a*) showing another embodiment of a continuous casting nozzle in accordance with the present.
Figure 2B:
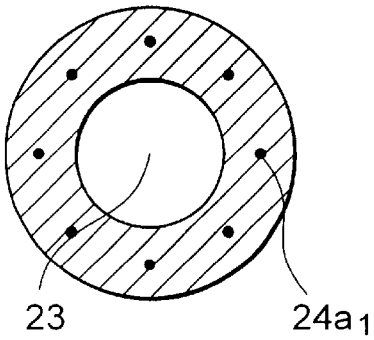
Figure 2C:
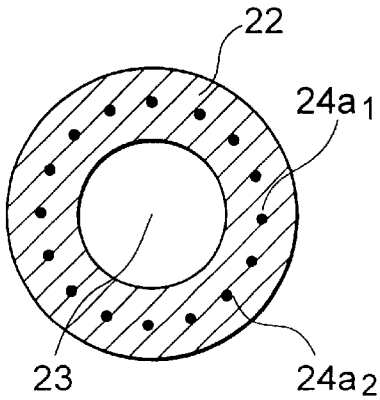
Figure 2D:
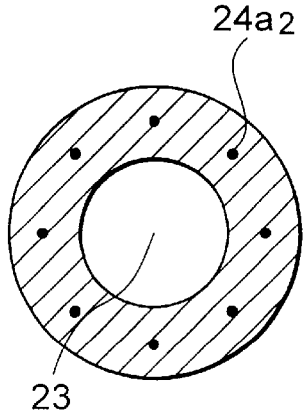

FIG. 1(*a*) is a front view showing one embodiment of a continuous casting nozzle in accordance with the present invention. A nozzle main body includes a neck portion, a middle portion, and a lower portion, which are integrally molded. Although a nozzle shown in this embodiment is a long nozzle, it is not limited to a long nozzle, and the present invention can be applied to any other nozzle (for example, immersion nozzle) whose essential part in accordance with the present invention has substantially the same construction. A nozzle main body A is a substantially cylindrical nozzle formed by a refractory material 2, and the thickness of the refractory material 2 increases at the upper part above the vicinity 1 of the neck portion. An inner bore 3 through which molten metal flows runs from the very top end to the very bottom end of the nozzle at the central portion of the nozzle. The inner bore 3 expands upward in the upper end portion thereof in a substantially conical shape.

As shown in FIG. 1(*a*), in the refractory material 2 forming the neck portion of the nozzle main body A, a plurality of metal bars 4*a* are embedded at substantially equal intervals along the longitudinal direction of the nozzle main body. FIG. 1(*b*) is a sectional view taken along the line B—B of the neck portion of the nozzle main body. As shown in FIG. 1(*b*), a substantially cylindrical refractory product with the inner bore 3 provided at the center portion thereof is formed, and eight metal bars 4*a* are embedded at substantially equal intervals along the central portion of annular cross section of the refractory material.

The metal bar in the present invention may be a bar having any shape in cross section, such as a round bar having a circular, elliptical, polygonal, or star shape, a flat-shaped bar, a square bar, or star-shaped bar. The metal bar 4*a* preferably has an outer diameter of at least 3 mm. The reason for this is that if the outer diameter is below 3 mm, the vicinity 1 of the neck portion may not be effectively protected against vibrations applied to the nozzle main body A during casting.

Also, the length of the above-described metal bar 4*a* preferably lies in the range from a location of at least 5 cm above a point 6 at which an inclined surface of the neck portion intersects a vertical surface thereof in the vicinity 1 of the neck portion of the nozzle main body A to a location of at least 15 cm below the point 6. The reason for this is that if the upper end of the metal bar is located at a distance shorter than 5 cm above the point 6 at which an inclined surface of the neck portion intersects a vertical surface thereof, the upper portion of the neck portion may not be effectively protected against vibrations applied to the nozzle main body A during casting, and if the lower end of the metal bar is located at a distance shorter than 15 cm below the point 6 at which an inclined surface of the neck portion intersects a vertical surface thereof, the lower portion of the neck portion may not be effectively protected against vibrations applied to the nozzle main body A during casting.

As the material of the metal bar, stainless steel, steel (for example, heat-resisting steel or carbon steel), or alloy steel of titanium or molybdenum can be used. Needless to say, a steel shell can be wound around the outer periphery of the vicinity 1 of the neck portion of the nozzle main body in accordance with the present invention as in the case of the conventional nozzle.

FIGS. 2(*a*) to 2(*d*) show another embodiment of a continuous casting nozzle in accordance with the present invention. As shown in FIG. 2(*a*), in the continuous casting nozzle of this embodiment, a plurality of metal bars consist of metal bars 24*a*1 embedded inside the refractory material forming the vicinity 21 of the neck portion of the nozzle main body and (another) separate metal bars 24*a*2 embedded inside the refractory material forming the lower portion of the nozzle main body. Further, the metal bars 24*a*1 and the separate metal bars 24*a*2 are embedded so that they are extended to the middle portion of the nozzle main body, and are partially overlapped with each other at the middle portion.

FIG. 2(*b*) is a sectional view taken along the line E—E of the nozzle neck portion. As shown in FIG. 2(*b*), the eight metal bars are embedded at equal intervals in the vicinity of the neck portion. FIG. 2(*c*) is a sectional view taken along the line F—F of the nozzle middle portion. As shown in FIG. 2(*c*), the eight metal bars 24*a*1 and the eight separate metal bars 24*a*2 are arranged alternately at the middle portion of the nozzle main body. Further, FIG. 2(*d*) is a sectional view taken along the line G—G of the nozzle lower portion. As shown in FIG. 2(*d*), the eight separate metal bars are embedded at equal intervals at the lower portion of the nozzle main body. According to the continuous casting nozzle of the embodiment shown in FIG. 2, the strength of the neck portion and lower portion, and additionally the middle portion of the nozzle main body is enhanced, so that the breakage of neck portion and the falling-off of the lower end portion can be prevented.

Figure 3A:
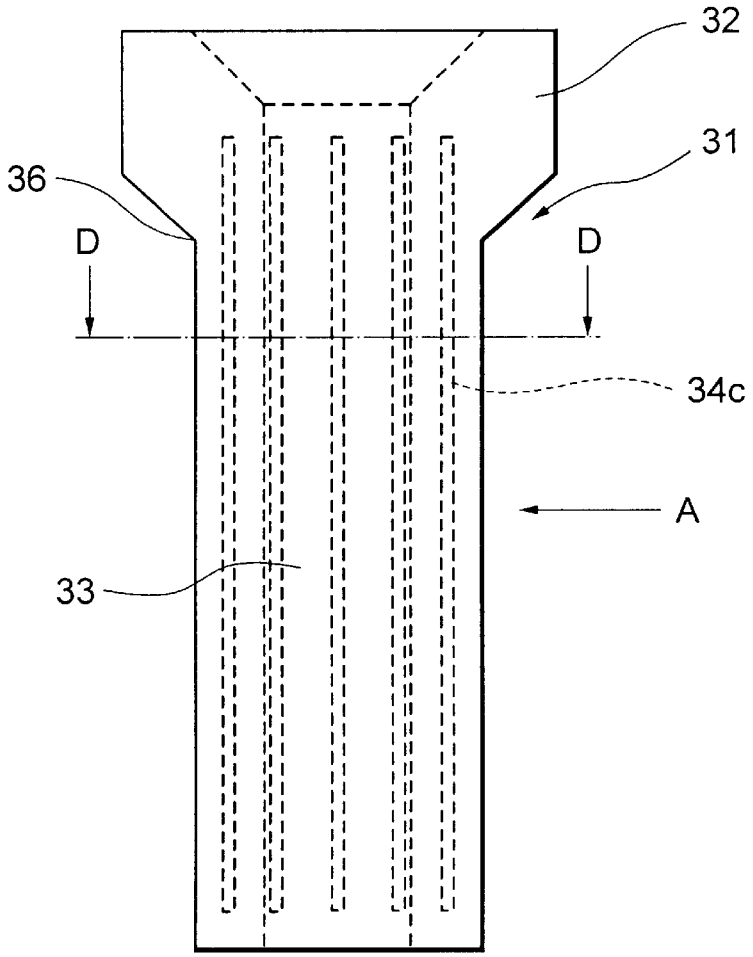
FIG. 3(*a*) is a front view showing further another embodiment of a continuous casting nozzle in accordance with the present invention, and FIG. 3(*b*) is a sectional view taken along the line D—D of FIG. 3(*a*) showing further another embodiment of a continuous casting nozzle in accordance with the present invention.
Figure 3B:
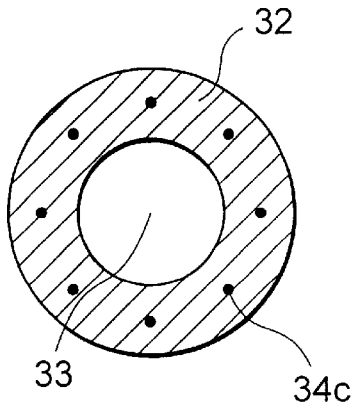

FIG. 3(*a*) shows one embodiment of the continuous casting nozzle in accordance with the present invention, in which metal bars 34*c* of a length ranging from the vicinity of the neck portion of the nozzle main body A down to the vicinity of the lower end are embedded in place of the metal bars 4*a* of the embodiment shown in FIG. 1. FIG. 3(*b*) is a sectional view taken along the line D—D of the nozzle main body. More specifically, the lower end of the metal bar 34*c* is located at a position about 10 cm above the lower end of the nozzle main body A. The construction in the vicinity of the neck portion is the same as that of the embodiment shown in FIG. 1. According to the continuous casting nozzle of the embodiment shown in FIG. 3, the neck breakage of nozzle can be prevented, and at the same time, the lower end portion can be prevented from falling off.

Figure 4A:
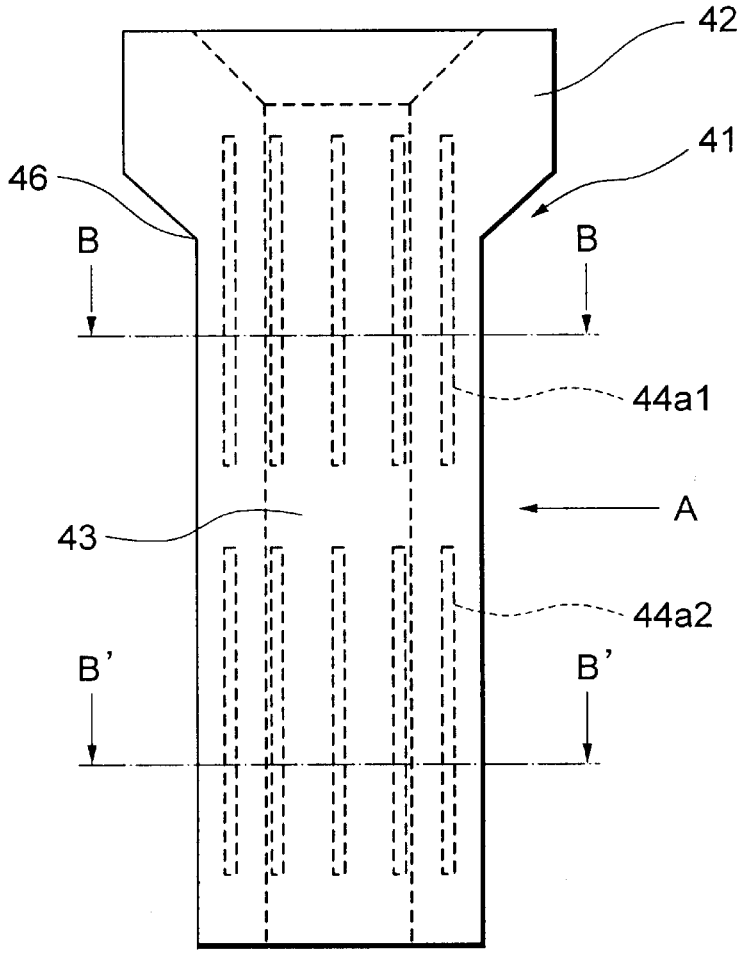
FIG. 4(*a*) is a front view showing further another embodiment of a continuous casting nozzle in accordance with the present invention, and FIG. 4(*b*) is a sectional view taken along the line B—B of FIG. 4(*a*) showing further another embodiment of a continuous casting nozzle in accordance with the present invention.
Figure 4B:
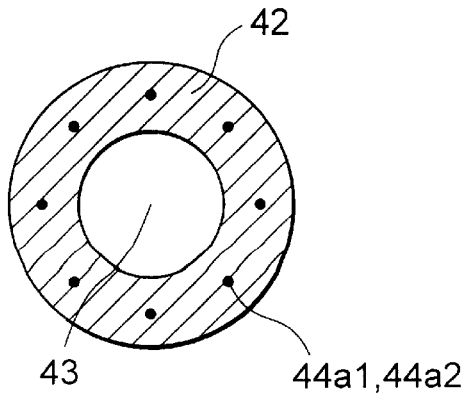

FIGS. 4(*a*) and 4(*b*) show another embodiment of the continuous casting nozzle in accordance with the present invention. As shown in FIG. 4(*a*), in the continuous casting nozzle of this embodiment, a plurality of metal bars consist of metal bars 44*a*1 embedded inside the refractory material forming the vicinity 41 of the neck portion of the nozzle main body and separate metal bars 44*a*2 embedded inside the refractory material forming the lower portion of the nozzle main body. More specifically, at the middle portion of the nozzle main body between the metal bars 44*a*1 and the separate metal bars 44*a*2, metal bars are not embedded. According to the continuous casting nozzle of the embodiment shown in FIG. 4, the strength of the neck portion and lower portion of the nozzle main body is enhanced, so that the breakage of neck and the falling-off of the lower end portion can be effectively prevented.

Figure 5A:
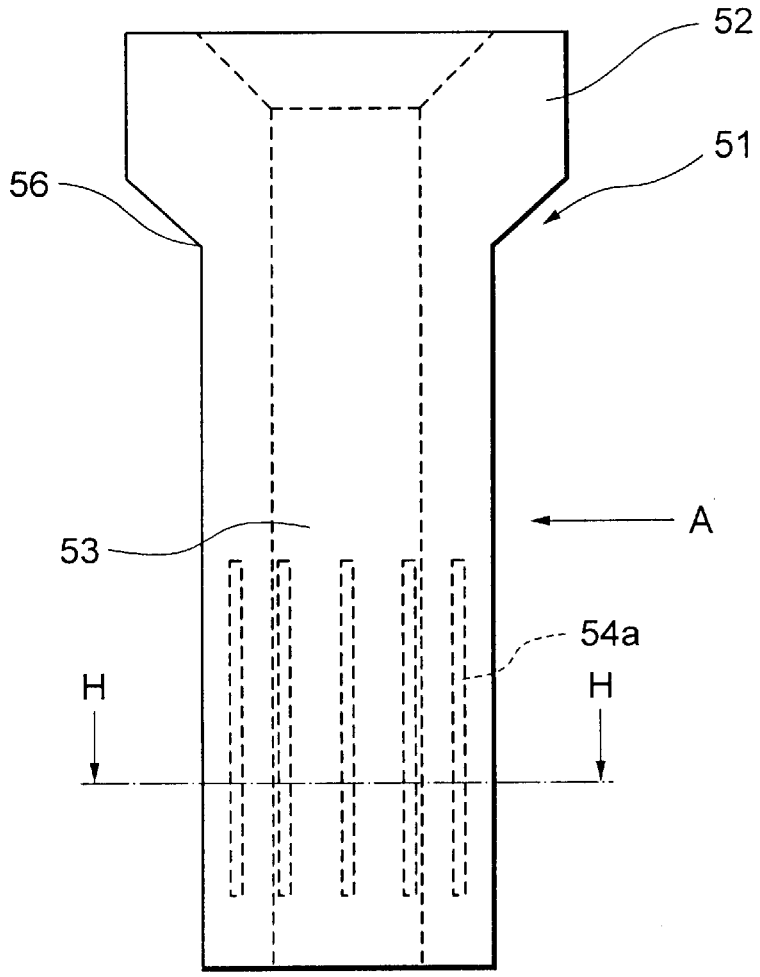
FIG. 5(*a*) is a front view showing further another embodiment of a continuous casting nozzle in accordance with the present invention, and FIG. 5(*b*) is a sectional view taken along the line H—H of FIG. 5(*a*) showing further another embodiment of a continuous casting nozzle in accordance with the present invention.
Figure 5B:
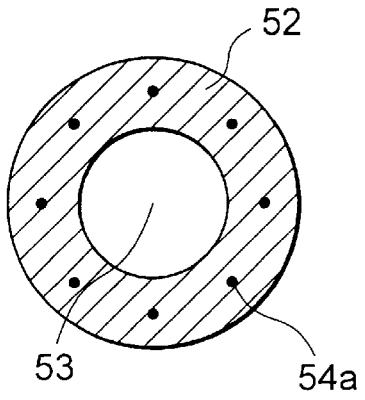

FIGS. 5(*a*) and 5(*b*) show still another embodiment of the continuous casting nozzle in accordance with the present invention. As shown in FIG. 5(*a*), in the continuous casting nozzle of this embodiment, a plurality of metal bars consist of metal bars 54*a* are embedded only inside the refractory material forming the lower portion of the nozzle main body. According to the continuous casting nozzle of the embodiment shown in FIG. 5, the strength of lower portion of the nozzle main body is enhanced, so that the end portion can be effectively prevented from falling off.

Figure 6A:
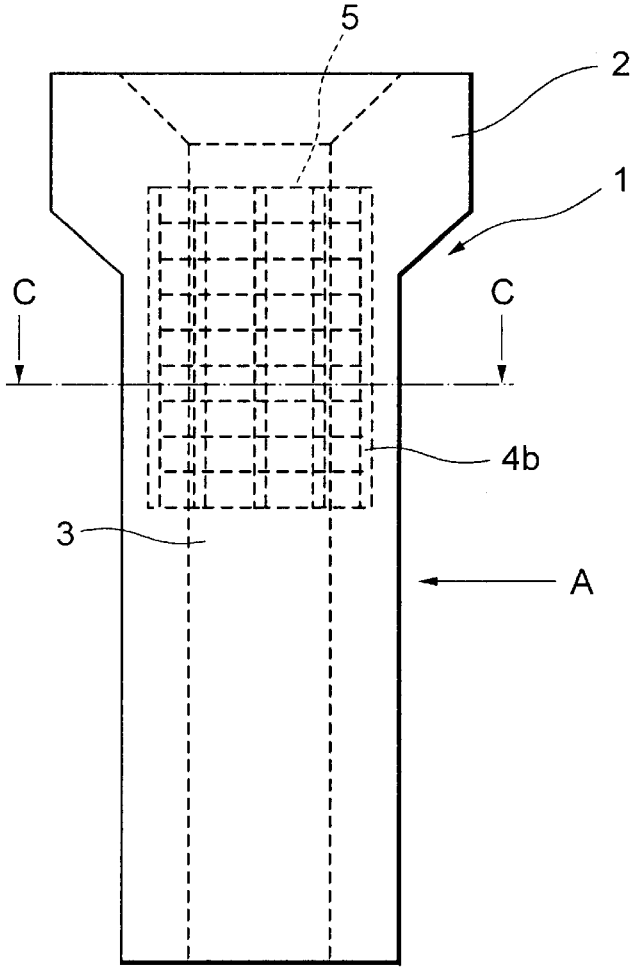
FIG. 6(*a*) is a front view showing further another embodiment of a continuous casting nozzle in accordance with the present invention, and FIG. 6(*b*) is a sectional view taken along the line C—C of FIG. 6(*a*) showing further another embodiment of a continuous casting nozzle in accordance with the present invention.
Figure 6B:
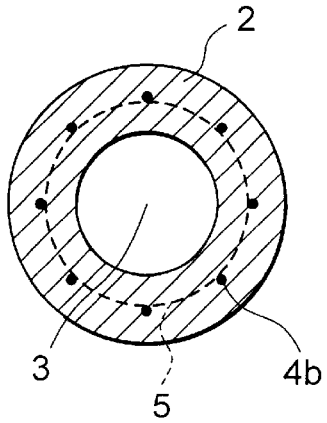

FIGS. 6(*a*) and 6(*b*) show still another embodiment of the continuous casting nozzle in accordance with the present invention. As shown in FIGS. 6(*a*) and 6(*b*), in the refractory material 2 in the vicinity 1 of the neck portion of the nozzle main body A, the plurality of stainless steel bars 4*b* with an outer diameter of at least 3 mm are embedded along the longitudinal direction of the nozzle main body at substantially equal intervals, and furthermore a plurality of stainless steel bars 5 with a diameter of up to 1 mm are embedded in an annular form in the direction perpendicular to the longitudinal direction of the nozzle main body at substantially equal intervals. Thereby, the strength of the vicinity 1 of the neck portion of the nozzle main body is enhanced, so that the occurrence of cracking and the breaking are prevented. In the above-described embodiment, when the plurality of metal bars are embedded, a metal net may be used additionally. By the additional use of the metal net, the strength of the nozzle main body can be enhanced without increasing the cost of the whole refractory while the charge of raw refractory material is made uniform at the time of molding.

EXAMPLES

Example 1

The continuous casting nozzle of the invention will be described further in detail with reference to examples. The embodiment of the continuous casting nozzle of the present invention shown in FIGS. 1(*a*) and 1(*b*) was applied between a tundish and a ladle with a capacity of 300 t, and low-carbon-aluminum killed steel was cast practically with the use of a slab continuous casting machine. The casting time thereof was about 60 minutes/ladle. The nozzle main body A of the continuous casting nozzle of the present invention had an overall length of 1300 mm, and an outer diameter excluding the upper end portion of 190 mm. In addition, the diameter of the inner bore 3 was 110 mm. In the continuous casting nozzle of the present invention, eight metal bars 4*a* having an outer diameter of 4 mm were embedded in the refractory material 2 in the vicinity 1 of the neck portion at equal intervals.

For comparison, a conventional long nozzle in which metal bars were not embedded was applied between a tundish and a ladle with a capacity of 300 t, and low-carbon aluminum killed steel was cast practically with the use of a slab continuous casting machine. The casting time thereof was 60 minutes/ladle. The main body A of the conventional long nozzle had the same size as that of the nozzle main body of the present invention, that is, the overall length was 1300 mm, the outer diameter excluding the upper end portion was 190 mm, and the inside diameter of the inner bore 3 was 110 mm.

There are shown in Tables 1 and 2 the results of the comparison test of the continuous casting nozzle of the present invention with the long nozzle for comparison, in which metal bars were not embedded.

TABLE 1

| | |
|---|---|
| Capacity of ladle | 300 t |
| Kind of cast steel | low-carbon aluminum killed steel |
| Casting time | about 60 min./ladle |

TABLE 2

| | | |
|---|---|---|
| Conventional long nozzle | erosion in the immersed portion | 58% |
| | erosion in the inner portion | 12% |
| | neck breakage | 4% |
| | falling off of the lower end portion | 3% |
| | others | 23% |
| Examples | erosion in the immersed portion | 61% |
| | erosion in the inner portion | 10% |
| | neck breakage | 0% |
| | falling off of the lower end portion | 0% |
| | others | 28% |

Table 1 shows casting conditions in the comparison test, and Table 2 shows the test results (more specifically, causes for being discarded).

As is apparent from Table 2, about 4% of the conventional nozzles reinforced by a steel shell wound around the outer periphery of the nozzle neck portion expired the service life due to the neck breakage before the average service life (about 620 minutes) was expired. On the contrary, no nozzle of this embodiment (50 nozzles) expired the service life due to the neck breakage even after an average service life of 625 minutes was expired.

Example 2

The continuous casting nozzle of the invention will be described further in detail with reference to examples. The embodiment of the continuous casting nozzle of the present invention shown in FIGS. 2(*a*) to 2(*d*) was applied between a tundish and a ladle with a capacity of 300 t, and low-carbon aluminum killed steel was cast practically with the use of a slab continuous casting machine. The casting time thereof was about 60 minutes/ladle. The nozzle main body A of the continuous casting nozzle of the present invention had an overall length of 1300 mm, and an outer diameter excluding the upper end portion of 190 mm. In addition, the diameter of the inner bore 3 was 110 mm. In the continuous casting nozzle of the present invention, eight metal bars 24*a* having an outer diameter of 4 mm were embedded at equal intervals inside the refractory material 22 in the vicinity 1 of the neck portion and at the lower portion, respectively. The metal bars embedded in the neck portion and the metal bars embedded in the lower portion were overlapped with each other at the middle portion of the nozzle main body.

For comparison, a conventional long nozzle in which metal bars were not embedded was applied between a tundish and a ladle with a capacity of 300 t, and low-carbon aluminum killed steel was cast practically with the use of a slab continuous casting machine. The casting time thereof was 60 minutes/ladle. The main body A of the conventional long nozzle had the same size as that of the nozzle main body of the present invention, that is, the overall length was 1300 mm, the outer diameter excluding the upper end portion was 190 mm, and the inside diameter of the inner bore 3 was 110 mm.

There are shown in Table 3 the results of the comparison test of the continuous casting nozzle of the present invention with the long nozzle for comparison, in which metal bars were not embedded.

TABLE 3

| Examples | |
|---|---|
| erosion in the immersed portion | 65% |
| erosion in the inner portion | 4% |
| neck breakage | 0% |
| falling off of the lower end portion | 0% |
| others | 31% |

As is apparent from Table 3, about 4% of the conventional nozzles reinforced by a steel shell wound around the outer periphery of the nozzle neck portion expired the service life due to the neck breakage before the average service life (about 620 minutes) was expired. On the contrary, no nozzle of this embodiment (50 nozzles) expired the service life due to the neck breakage even after an average service life of 625 minutes was expired. Furthermore, the lower end portion of about 3% of the conventional nozzles fell off. Contrarily, the lower end portion of no continuous casting nozzle of the present invention fell off because the lower portion thereof is reinforced by the metal bars.

Example 3

The embodiment of the continuous casting nozzle of the present invention shown in FIGS. 3(*a*) and 3(*b*) was used between a ladle with a capacity of 300 t and a tundish, and low-carbon aluminum killed steel was cast actually using a slab continuous casting machine. The casting time thereof was about 60 minutes/ladle. The nozzle main body A of the continuous casting nozzle of the present invention had an overall length of 1300 mm, and an outer diameter excluding the upper end portion of 190 mm. The inner bore 3 had an inside diameter of 110 mm. In this embodiment of the continuous casting nozzle of the present invention, eight metal bars 34*a* with an outer diameter of 4 mm were embedded at equal intervals inside the refractory material 32 within the range from the vicinity of the neck portion, through the middle portion down to the lower portion.

For comparison, a conventional long nozzle in which metal bars were not embedded was used between a ladle with a capacity of 300 t and a tundish, and low-carbon aluminum killed steel was cast actually using a slab continuous casting machine. The casting time thereof was 60 minutes/ladle. The main body A of the conventional long nozzle had the same size as that of the above embodiment of the nozzle main body of the present invention, that is, the overall length was 1300 mm, the outer diameter excluding the upper end portion was 190 mm, and the inside diameter of the inner bore 3 was 110 mm.

The continuous casting nozzle of the present invention was compared with the conventional long nozzle for comparison, in which metal bars were not embedded. The results of the comparison test are shown below.

TABLE 4

| Examples | |
|---|---|
| erosion in the immersed portion | 62% |
| erosion in the inner portion | 8% |
| neck breakage | 0% |
| falling off of the lower end portion | 0% |
| others | 30% |

As is apparent from Table 4, about 4% of the conventional nozzles. reinforced by a steel shell wound around the outer periphery of the nozzle neck portion expired the service life due to the neck breakage before the average service life (about 620 minutes) was expired. On the contrary, no nozzle of this embodiment (50 nozzles) expired the service life due to the neck breakage even after an average service life of 625 minutes was expired. Furthermore, the lower end portion of about 3% of the conventional nozzles fell off. Contrarily, the lower end portion of no continuous casting nozzle of the present invention fell off because the refractory is reinforced from the neck portion through the middle portion down to the lower portion by the metal bars.

Example 4

The embodiment of the continuous casting nozzle of the present invention shown in FIGS. 4(*a*) and 4(*b*) was used between a ladle with a capacity of 300 t and a tundish, and low-carbon aluminum killed steel was cast actually using a slab continuous casting machine. The casting time thereof was about 60 minutes/ladle. The nozzle main body A of the continuous casting nozzle of the present invention had an overall length of 1300 mm, and an outer diameter excluding the upper end portion of 190 mm. The inner bore thereof had an inside diameter of 110 mm. In this embodiment of the continuous casting nozzle of the present invention, eight metal bars 44*a*1 and 44*a*2 having an outer diameter of 4 mm were embedded at equal intervals inside the refractory material 32 in the vicinity of the neck portion and in the lower portion, respectively. More specifically, in the middle portion of the nozzle main body, metal bars were not embedded.

For comparison, a conventional long nozzle in which metal bars were not embedded was used between a ladle with a capacity of 300 t and a tundish, and low-carbon aluminum killed steel was cast actually using a slab continuous casting machine. The casting time thereof was 60 minutes/ladle. The main body A of the conventional long nozzle had the same size as that of the above nozzle main body of the present invention, that is, the overall length was 1300 mm, the outer diameter excluding the upper end portion was 190 mm, and the inside diameter of the inner bore 3 was 110 mm.

The continuous casting nozzle of the present invention was compared with the long nozzle for comparison, in which metal bars were not embedded. The results of the comparison test are shown below.

TABLE 5

| Examples | |
|---|---|
| erosion in the immersed portion | 53% |
| erosion in the inner portion | 12% |
| neck breakage | 0% |
| falling off of the lower end portion | 0% |
| others | 35% |

As is apparent from Table 5, about 4% of the conventional nozzles reinforced by a steel shell wound around the outer periphery of the nozzle neck portion expired the service life due to the neck breakage before the average service life (about 620 minutes) was expired. On the contrary, no nozzle of this embodiment (50 nozzles) expired the service life due to the neck breakage even after an average service life of 625 minutes was expired. Furthermore, the lower end portion of about 3% of the conventional nozzles fell off. Contrarily, the lower end portion of no continuous casting nozzle of the present invention fell off because the refractory is reinforced in both of the neck portion and the lower portion by the metal bars.

Example 5

The embodiment of the continuous casting nozzle of the present invention shown in FIGS. 5(*a*) and 5(*b*) was used between a ladle with a capacity of 300 t and a tundish, and low-carbon aluminum killed steel was cast actually using a slab continuous casting machine. The casting time thereof was about 60 minutes/ladle. The nozzle main body A of the continuous casting nozzle of the present invention had an overall length of 1300 mm, and an outer diameter excluding the upper end portion of 190 mm. The inner bore thereof had an inside diameter of 110 mm. In this embodiment of the continuous casting nozzle of the present invention, eight metal bars 54*a* having an outer diameter of 4 mm were embedded inside the refractory material 52 in the lower portion at equal intervals.

For comparison, a conventional long nozzle in which metal bars were not embedded was used between a ladle with a capacity of 300 t and a tundish, and low-carbon aluminum killed steel was cast actually using a slab continuous casting machine. The casting time thereof was 60 minutes/ladle. The main body A of the conventional long nozzle had the same size as that of the above nozzle main body of the present invention, that is, the overall length was 1300 mm, the outer diameter excluding the upper end portion was 190 mm, and the inside diameter of the inner bore 3 was 110 mm.

The continuous casting nozzle of the present invention was compared with the long nozzle for comparison, in which metal bars were not embedded. The results of the comparison test are shown below.

TABLE 6

| | | |
|---|---|---|
| Examples | erosion in the immersed portion | 58% |
| | erosion in the inner portion | 3% |
| | neck breakage | 2% |
| | falling off of the lower end portion | 0% |
| | others | 37% |

As is apparent from Table 6, about 4% of the conventional nozzles reinforced by a steel shell wound around the outer periphery of the nozzle neck portion expired the service life due to the neck breakage before the average service life (about 620 minutes) was expired. On the contrary, one nozzle of this embodiment (50 nozzles) expired the service life due to the neck breakage when an average service life of 625 minutes was expired. Furthermore, the lower end portion of about 3% of the conventional nozzles fell off. Contrarily, the lower end portion of no continuous casting nozzle of the present invention fell off because the refractory is reinforced in the lower portion by the metal bars.

Example 6

The embodiment of the continuous casting nozzle of the present invention shown in FIGS. 6(*a*) and 6(*b*) was used between a ladle and a tundish to perform casting for 1000 minutes in the same manner as in Example 5. The conventional long nozzle shown in FIG. 7 was used between a ladle and a tundish, and low-carbon aluminum killed steel was cast in the same manner as in Example 5. As shown in FIGS. 6(*a*) and 6(*b*), eight stainless steel bars having an outer diameter of 4 mm were arranged along the vertical direction, and ten stainless steel bars having an outer diameter of 0.5 mm were arranged along the horizontal direction at intervals of 3 cm. Thus arranged bars were embedded inside the neck portion of the long nozzle main body. The long nozzle main body had an inside diameter of 100 mm, an outer diameter of 180 mm, and an overall length of 1200 mm. Then, molding and firing were performed to manufacture the continuous casting long nozzle. Low-carbon aluminum killed steel was cast with the use of a slab continuous casting machine. The casting conditions are shown in Table 7, and the casting results are shown in Table 8.

TABLE 7

| Kind of steel | Capacity of ladle | Capacity of tundish | Charge number | Casting time |
|---|---|---|---|---|
| Aluminum killed steel | 250 t | 50 t | 22 times | 1000 minutes |

TABLE 8

| | Breakage | Thickness of erosion in inner bore | Thickness of oxidization in peripheral portion | Number of pieces |
|---|---|---|---|---|
| Nozzle of invention | 0 | 14 mm | 3 mm | 15 |
| Conventional nozzle | 3 | 12 mm | 3 mm | 12 |

As is apparent from Tables 7 and 8, the conventional long nozzle was broken when 800 minutes passed after the start of casting. On the contrary, low-carbon aluminum killed steel was cast for 1000 minutes by the continuous casting nozzle of the present invention, although the inner bore portion of the invention was eroded slightly larger than that of the conventional long nozzle and had reduced thickness of the nozzle after the casting.

Example 7

The embodiment of the continuous casting nozzle of the present invention shown in FIGS. 6(*a*) and 6(*b*) was used between a ladle and a tundish to perform casting for 1100 minutes in the same manner as in Example 5. The conventional long nozzle shown in FIG. 7 was used between a ladle and a tundish, and low-carbon aluminum killed steel was cast in the same manner as in Example 5. As shown in FIGS. 6(*a*) and 6(*b*), eight stainless steel bars having an outer diameter of 4 mm were arranged along the vertical direction at the central portion of the wall thickness inside the continuous casting nozzle of the present invention, three stainless steel bars having an outer diameter of 0.5 mm were arranged on the upper side of the point at which an inclined surface of the neck portion intersects a vertical surface thereof, and the same seven stainless steel bars were arranged on the lower side of the point, along the horizontal direction at intervals of 3 cm, and these bars were embedded in the central portion of the wall thickness of the neck portion of the long nozzle body having an inside diameter of 110 mm, an outer diameter of 190 mm, and an overall length of 1300 mm. Then, molding and firing were performed to manufacture the continuous casting long nozzle. Low-carbon aluminum killed steel was cast with the use of a slab continuous casting machine. The casting conditions are shown in Table 9, and the casting results are shown in Table 10.

TABLE 9

| Kind of steel | Capacity of ladle | Capacity of tundish | Charge number | Casting time |
|---|---|---|---|---|
| Aluminum killed steel | 250 t | 50 t | 24 times | 1100 minutes |

TABLE 10

| | Breakage | Thickness of erosion in inner bore | Thickness of oxidization in peripheral portion | Number of pieces |
|---|---|---|---|---|
| Nozzle of invention | 0 | 14 mm | 3 mm | 15 |
| Conventional nozzle | 3 | 12 mm | 3 mm | 12 |

As is apparent from Tables 9 and 10, the conventional long nozzle was broken when 800 minutes passed after the start of casting. On the contrary, low-carbon aluminum killed steel was cast for 1100 minutes by the continuous casting nozzle of the present invention, although the inner bore portion of the invention was eroded slightly larger than that of the conventional long nozzle and ha d reduced thickness of the nozzle after the casting.

Example 8

The embodiment of the continuous casting nozzle of the present invention shown in FIGS. 6(*a*) and 6(*b*) was used between a ladle and a tundish to perform casting for 1000 minutes in the same manner as in Example 5. The conventional long nozzle shown in FIG. 7 was used between a ladle and a tundish, and low-carbon aluminum killed steel was cast in the same manner as in Example 5. As shown in FIGS. 6(*a*) and 6(*b*), eight stainless steel bars having an outer diameter of 4 mm were arranged along the vertical direction at a position 1.8 cm distant from the inner bore surface inside the continuous casting nozzle of the present invention, ten stainless steel bars having an outer diameter of 0.5 mm were arranged along the horizontal direction at intervals of 3 cm. Thus arranged bars were embedded inside the neck portion of the long nozzle main body. The long nozzle main body had an inside diameter of 100 mm, an outer diameter of 180 mm, and an overall length of 1300 mm. Then, molding and firing were performed to manufacture the continuous casting long nozzle. Low-carbon aluminum killed steel was cast with the use of a slab continuous casting machine. The casting conditions are shown in Table 11, and the casting results are shown in Table 12.

TABLE 11

| Kind of steel | Capacity of ladle | Capacity of tundish | Charge number | Casting time |
|---|---|---|---|---|
| Aluminum killed steel | 250 t | 60 t | 20 times | 1000 minutes |

TABLE 12

| | Breakage | Thickness of erosion in inner bore | Thickness of oxidization in peripheral portion | Number of pieces |
|---|---|---|---|---|
| Nozzle of invention | 0 | 9 mm | 3 mm | 14 |
| Conventional nozzle | 5 | 8 mm | 3 mm | 15 |

As is apparent from Tables 11 and 12, the conventional long nozzle was broken when 800 minutes passed after the start of casting. On the contrary, low-carbon aluminum killed steel was cast for 1000 minutes by the continuous casting nozzle of the present invention, although the inner bore portion of the invention was eroded slightly larger than that of the conventional long nozzle and had reduced thickness of the nozzle after the casting.

Example 9

The embodiment of the continuous casting nozzle of the present invention shown in FIGS. 6(*a*) and 6(*b*) was used between a ladle and a tundish to perform casting for 1000 minutes in the same manner as in Example 5. The conventional long nozzle shown in FIG. 7 was used between a ladle and a tundish, and low-carbon aluminum killed steel was cast in the same manner as in Example 5. As shown in FIGS. 6(*a*) and 6(*b*), eight stainless steel bars having an outer diameter of 4 mm were arranged along the vertical direction inside the continuous casting nozzle of the present invention, ten stainless steel bars having an outer diameter of 0.5 mm were arranged along the horizontal direction at intervals of 3 cm. Thus arranged bars were embedded inside the neck portion of the long nozzle main body. The long nozzle main body had an inside diameter of 100 mm, an outer diameter of 180 mm, and an overall length of 1200 mm. Then, molding and firing were performed to manufacture the continuous casting long nozzle. Low-carbon aluminum killed steel was cast with the use of a slab continuous casting machine. The casting conditions are shown in Table 13, and the casting results are shown in Table 14.

TABLE 13

| Kind of steel | Capacity of ladle | Capacity of tundish | Charge number | Casting time |
|---|---|---|---|---|
| Aluminum killed steel | 250 t | 60 t | 20 times | 1000 minutes |

TABLE 14

| | Breakage | Thickness of erosion in inner bore | Thickness of oxidization in peripheral portion | Number of pieces |
|---|---|---|---|---|
| Nozzle of invention | 0 | 9 mm | 2 mm | 14 |
| Conventional nozzle | 5 | 8 mm | 4 mm | 15 |

As is apparent from Tables 13 and 14, the conventional long nozzle was broken when 800 minutes passed after the start of casting. On the contrary, low-carbon aluminum killed steel was cast for 1000 minutes by the continuous casting nozzle of the present invention, although the inner bore portion of the invention was eroded slightly larger than that of the conventional long nozzle and had reduced thickness of the nozzle after the casting. Furthermore, oxidized thickness caused in the outer peripheral portion was reduced ½ of that in the conventional long nozzle. In addition, neither breakage nor cracking occurred which proves that the long nozzle of the present invention has a sufficient strength without the outer steel shell wound around neck portion.

As described above, according to the continuous casting nozzle in accordance with the present invention, the strength of the neck portion of the nozzle main body, which has been a weak point of the conventional nozzle, can be enhanced dramatically without relying on a reinforcing iron plate etc. Further, since various metals including stainless steel can be used as the material of the embedded metal bar, a variety of materials can be selected according to the application.

According to the present invention, a danger of cracking or breaking of the continuous casting nozzle caused during casting can be decreased significantly, and high-quality steel can be supplied steadily. Also, effects that the operator is not endangered during work, that the useful service life of the continuous casing nozzle is prolonged, and that the total cost of refractories can be reduced are achieved.

Furthermore, by using various embodiments including an embodiment in which the metal bars embedded in the nozzle main body have a length reaching the vicinity of the lower end portion, an effect that the strength of the neck portion and the lower portion of the nozzle main body is enhanced, so that the neck breakage of the nozzle main body and the coming-off of the lower end portion thereof can be prevented is achieved.

What is claimed is:

1. A continuous casting nozzle comprising a nozzle main body including a neck portion, a middle portion and a lower portion, made of refractory material, having an inner bore through which molten metal flows; and a plurality of metal bars embedded inside said neck portion both in a vertical direction and a horizontal direction.

2. The continuous casting nozzle as claimed in claim 1, wherein a ratio of outer diameter of said metal bar embedded in a vertical direction to outer diameter of said metal bar embedded in a horizontal direction is within a range from 3/1 to 15/1.

3. The continuous casting nozzle as claimed in claim 1, wherein said plurality of metal bars embedded in a horizontal direction are embedded in said neck portion of said nozzle main body within an area ranging from at least 5 cm above a point in which an inclined surface of said neck portion intersects a vertical surface thereof to at least 15 cm below said point.

4. The continuous casting nozzle as claimed in claim 1, wherein said plurality of metal bars are embedded in a thickness direction of said neck portion within a range of at least 1.5 cm from a surface of said inner bore.

5. A continuous casting nozzle comprising a nozzle main body including a neck portion, a middle portion and a lower portion, made of refractory material, having an inner bore through which molten metal flows; a plurality of metal bars embedded inside of at least one portion of said refractory material forming said nozzle main body along a longitudinal direction thereof; and a metal net embedded together with said plurality of metal bars.

6. The continuous casting nozzle as claimed in claim 5, wherein said plurality of metal bars are embedded inside an area of said nozzle main body ranging from said neck portion through said middle portion to said lower portion.

7. The continuous casting nozzle as claimed in claim 5, wherein said plurality of metal bars are embedded inside said neck portion of said nozzle main body.

8. The continuous casting nozzle as claimed in claim 5, wherein said plurality of metal bars are embedded inside said lower portion of said nozzle main body.

9. The continuous casting nozzle as claimed in claim 5, wherein said plurality of metal bars comprise first metal bars embedded inside said neck portion of said nozzle main body and second metal bars embedded inside said lower portion of said nozzle main body.

10. The continuous casting nozzle as claimed in claim 9, wherein said first metal bars embedded inside said neck portion and said second metal bars embedded inside said lower portion respectively extend to said middle portion of said nozzle main body, and overlap in said middle portion.

* * * * *

UNITED STATES PATENT AND TRADEMARK OFFICE

CERTIFICATE OF CORRECTION

PATENT NO. : 6,454,144 B1 
APPLICATION NO. : 09/543752
DATED : September 24, 2002
INVENTOR(S) : Muroi et al.

Figure 7:
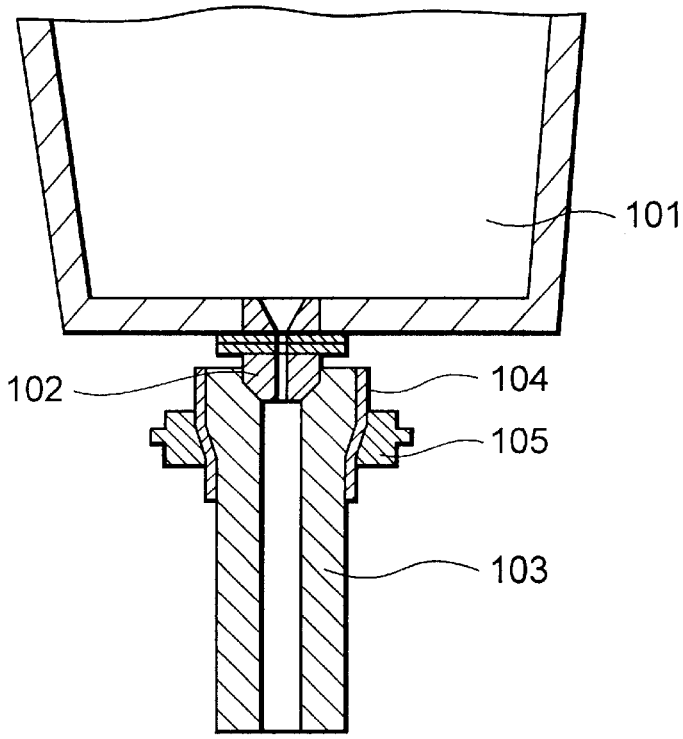
FIG. 7 is a sectional view of a conventional nozzle reinforced by winding a steel shell around the outer periphery in the vicinity of a neck portion of a nozzle main body.
Figure 8A:
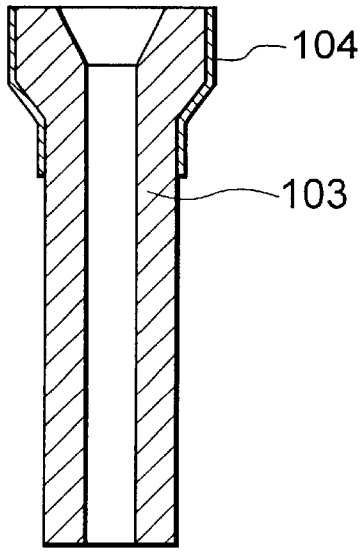
FIG. 8 is an explanatory view showing typical shapes of a conventional long nozzle.
Figure 8B:
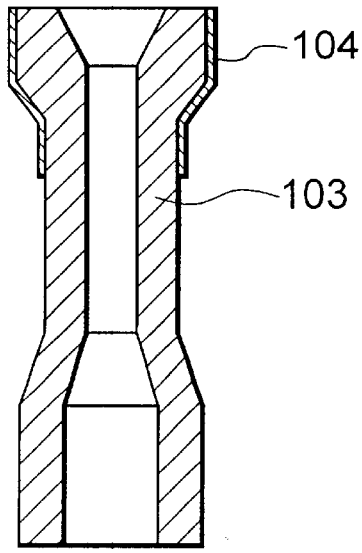

It is certified that error appears in the above-identified patent and that said Letters Patent is hereby corrected as shown below:

Drawings,
After "FIG. 7" insert -- PRIOR ART --.
After "FIG. 8A" insert -- PRIOR ART --.
After "FIG. 8B" insert -- PRIOR ART --.

Column 1,
Line 18, after "the" delete "continues" and insert -- continuous --.

Column 2,
Line 28, before "disastrous" delete "casing" and insert -- causing --.

Column 3,
Line 33, after "comprise" delete "a".
Line 35, after "and" delete "a".

Column 6,
Line 45, after "and" delete "the another" and insert -- other --.

Column 7,
Line 54, after "metal" delete "bars" and insert -- bar --.

Column 14,
Line 58, after "and" delete "ha d" and insert -- had --.

Column 16,
Line 46, after "continuous" delete "casing" and insert -- casting --.

Signed and Sealed this

Twenty-seventh Day of June, 2006

JON W. DUDAS
*Director of the United States Patent and Trademark Office*